US005730855A

United States Patent [19]

Luebke et al.

[11] Patent Number: 5,730,855

[45] Date of Patent: Mar. 24, 1998

[54] HOIST APPARATUS AND METHOD FOR POSITIONING ANODE IN SMELTING FURNACE

[75] Inventors: Roger D. Luebke, Hartford; Randy H. Khoury, Muskego, both of Wis.

[73] Assignee: Harnischfeger Corporation, Milwaukee, Wis.

[21] Appl. No.: 585,829

[22] Filed: Jan. 16, 1996

Related U.S. Application Data

[63] Continuation of Ser. No. 999,608, Dec. 31, 1992, Pat. No. 5,549,799.

[51] Int. Cl.[6] ..... C25C 3/00; C25C 7/00

[52] U.S. Cl. ..... 205/354; 204/225; 204/245; 205/367

[58] Field of Search ..... 205/354, 367, 205/336; 204/225, 245

[56] References Cited

U.S. PATENT DOCUMENTS

| | | | |
|---|---|---|---|
| 2,816,861 | 12/1957 | Castex | 204/243 R X |
| 3,245,898 | 4/1966 | Wunderli | 204/243 R X |
| 3,761,379 | 9/1973 | Elliot | 204/225 |
| 4,039,419 | 8/1977 | Buse | 204/245 X |
| 4,210,513 | 7/1980 | Mutschler et al. | 204/245 X |
| 4,465,578 | 8/1984 | Duclaux et al. | 204/245 |
| 4,500,401 | 2/1985 | Clark et al. | 204/245 X |
| 4,631,121 | 12/1986 | Stewart et al. | 204/243 R |
| 4,664,760 | 5/1987 | Jarrett | 205/375 |
| 4,865,701 | 9/1989 | Beck et al. | 205/375 |
| 5,288,383 | 2/1994 | Sparwald et al. | 204/245 X |

*Primary Examiner*—Donald R. Valentine

*Attorney, Agent, or Firm*—Michael, Best & Friedrich LLP

[57] ABSTRACT

An anode positioning hoist supported on an overhead crane used in a smelting apparatus including a cathode with an upwardly facing surface and an anode with a downwardly facing surface. The anode positioning hoist includes a pair of channel members defining opposed vertical channels and a cylinder/piston assembly including a cylinder located between the channel members and a piston rod extending downwardly from the cylinder. A carrier is fixed to the piston rod for movement therewith and includes rollers guided in the channels. A connector assembly is mounted on the carrier to releasably secure the anode to the carrier. A control system including a counterbalance valve mounted on the cylinder and a pressure switch operates to cause extension of the piston rod until the downwardly facing surface of the anode engages the upwardly facing surface of the cathode. The control system thereafter causes retraction of the piston rod a predetermined distance to provide a desired anode-cathode gap.

15 Claims, 4 Drawing Sheets

HOIST APPARATUS AND METHOD FOR POSITIONING ANODE IN SMELTING FURNACE

This is a continuation of application Ser. No. 07/999,608, filed Dec. 31, 1992, now U.S. Pat. No. 5,549,799 entitled "Hoist Apparatus For Positioning Anode In Smelting Furnace".

BACKGROUND OF THE INVENTION

1. Field of the Invention

The invention relates to a smelting apparatus including an electrolytic cell used in the electrolysis of a metal compound to produce the metal, and more particularly to a hoist apparatus for positioning an anode relative to a cathode to achieve a desired predetermined anode-cathode gap.

2. Reference to Prior Art

The electrolysis of alumina ($Al_2O_3$) to produce aluminum is a well known process involving an electrochemical oxidation-reduction reaction. A smelter used in this process includes an electrolytic cell including a plurality of anodes and a pot which contains an electrolyte and which functions as a cathode. The anodes are immersed in the electrolyte and are positioned above the floor of the pot to provide an anode-cathode separation distance or "air" gap. An electrical current passes between the anodes and the cathode and through the electrolyte such that the aluminum constituent of the alumina is reduced together with a corresponding oxidation reaction.

For efficient operation of the electrolytic cell, the anode-cathode gap should be set and maintained at a predetermined optimum distance. For example, a potentially significant voltage drop can occur between the electrodes if the anode-cathode gap is too large, and short circuiting of the electrodes or re-oxidation of reduced aluminum can occur if the anode-cathode gap is too small. A gap distance that lies outside of an optimum range produces erratic heating and power loss and reduces anode life.

After the anode-cathode gap is initially set, it must be monitored and periodically reset to ensure proper anode positioning. For example, conventional carbon anodes are consumed over time and individual anodes can be consumed at different rates making resetting to account for changes in anode height necessary. Also, the floor of the pot can become uneven or warped over time and individual anodes must be set accordingly to achieve the desired spacing.

In a known process for adjusting anode position, workers manually raise and lower an anode with reference to paint lines placed on the anode stem. After checking the resistance at the bus bar, the position of the anode is adjusted, using the paint lines as a reference. This is repeated until a resistance value generally indicative of a satisfactory anode-cathode gap is obtained. This process is time consuming, requires the workers to remain in the unpleasant environment of the smelting furnace, and brings the workers into close proximity with the smelting furnace.

SUMMARY OF THE INVENTION

The invention provides an anode positioning hoist apparatus that is operable to automatically manipulate the position of anodes relative to a cathode in an electrolytic cell to consistently achieve a predetermined anode-cathode gap. The hoist is supportable on an overhead crane and is operable by a worker from a remote location to automatically lower the anode until it engages the cathode and thereafter automatically raise the anode a predetermined distance to provide a desired anode-cathode gap.

More particularly, the invention provides a hoist apparatus for positioning the anode relative to the cathode of a smelting furnace, the cathode having an upwardly facing surface, and the anode having a downwardly facing surface. The hoist apparatus is supported on an overhead crane and includes means for automatically moving the anode downwardly until the downwardly facing surface of the anode engages the upwardly facing surface of the cathode, and means for thereafter automatically moving the anode upwardly a predetermined distance to provide the desired anode-cathode gap.

The smelting furnace preferably includes a horizontal bus bar and a vertical bus bar having a lower end fixed to the anode. The anode positioning hoist includes a pair of channel members which are supported by the crane and which define opposed vertical channels. The anode positioning hoist also includes a cylinder/piston assembly including a cylinder located between the channel members and a piston rod extending downwardly from the cylinder. A carrier is fixed to the piston rod for movement therewith and includes rollers guided in the channels. Means are provided for releasably securing the vertical bus bar to the carrier so that the anode moves vertically with the carrier. A control system includes means for causing extension of the piston rod until the downwardly facing surface of the anode engages the upwardly facing surface of the cathode, and means for thereafter causing retraction of the piston rod a predetermined distance to achieve the desired anode-cathode gap. To fix this gap, means are also provided for releasably securing the vertical bus bar to the horizontal bus bar.

Other features and advantages of the invention will become apparent to those skilled in the art upon review of the following detailed description, claims and drawings.

Figure 1:
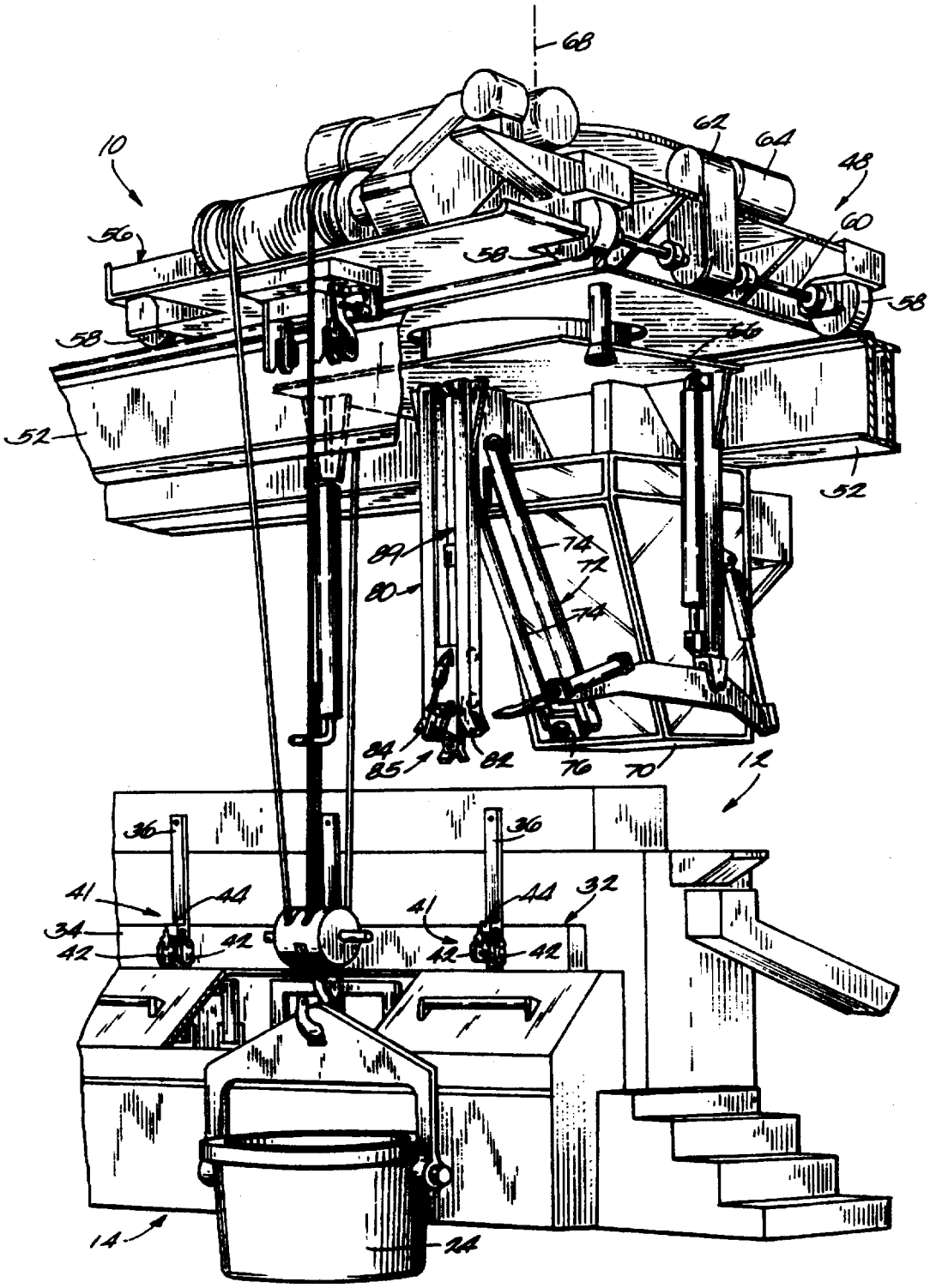
FIG. 1 is a perspective view of part of a smelting apparatus including an anode positioning hoist embodying various features of the invention.

Before one embodiment of the invention is explained in detail, it is to be understood that the invention is not limited in its application to the details of the construction and the arrangement of components set forth in the following description or illustrated in the drawings. The invention is capable of other embodiments and of being practiced or being carried out in various ways. Also, it is to be understood that the phraseology and terminology used herein is for the purpose of the description and should not be regarded as limiting.

GENERAL DESCRIPTION

Illustrated in FIG. 1 is a portion of a smelting apparatus 10 embodying the invention. In the specific embodiment illustrated in the drawings, the smelting apparatus 10 is employed in the production of metallic aluminum from alumina and operates to electrolytically reduce alumina to aluminum.

The smelting apparatus 10 comprises (see FIGS. 1 and 2) a row of electrolytic cells 12 (only one is shown). Each electrolytic cell 12 includes a smelting furnace or pot 14 having sidewalls 16 and a base 18 which is capable of conducting current and which acts as a cathode for the electrolysis process. The base 18 includes an internal upwardly facing surface or cell floor 20.

The pot 14 contains a molten electrolyte bath 22 preferably including cryolite. During the electrolysis process, liberated molten aluminum (not shown) settles to the bottom of the pot 14 and forms a bottom layer of the electrolyte bath 22. The molten aluminum is then removed such as by syphoning into crucibles 24 (one is shown in FIG. 1).

Figures 3, 4, 5, 7:
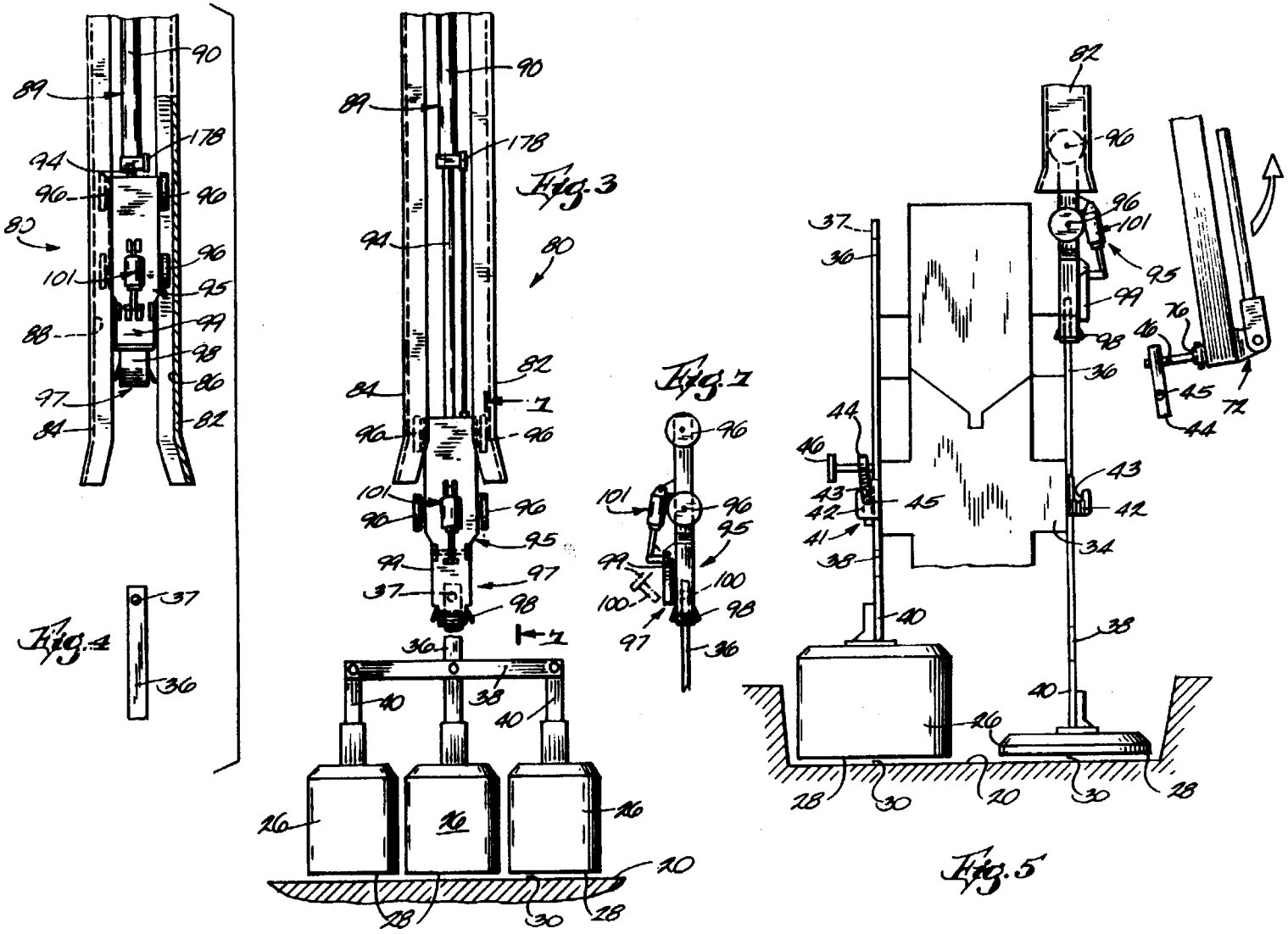
FIG. 3 is an enlarged view of a portion of the anode positioning hoist illustrated in FIG. 1 with the carrier in a lower position.
FIG. 4 is an exploded view, partially cut away, of the portion of the anode hoist illustrated in FIG. 3 with the carrier in an upper position.
FIG. 5 is an enlarged partial side elevational view, partially in section, of the smelting apparatus.
FIG. 7 is a view taken along line 7—7 in FIG. 3.

The electrolytic cell 12 also includes at least one and preferably a plurality of anodes 26 immersed in the electrolyte bath 22. While the anodes 26 can be arranged individually, in the illustrated embodiment, three-anode arrays are provided. As shown in FIGS. 3 and 5, each anode 26 has a downwardly facing surface 28 opposing the cell floor 20 and spaced a predetermined distance from the cell floor 20 to provide an anode-cathode gap 30.

The electrolytic cell 12 also includes means for supporting the anodes 26 above the cell floor 20 to maintain the desired anode-cathode gap 30. While various anode supporting means can be employed, in the illustrated arrangement such means includes (see FIG. 2) a bus bar assembly 32. The bus bar assembly 32 includes a horizontal bus bar 34 extending above the pot 14, and a plurality of vertical bus bars 36 each associated with one of the anode arrays. Each vertical bus bar 36 has an upper end having therethrough a bore 37 (see FIG. 4), the reason for which is explained below. Each bus bar 36 also has a lower end fixed to the center anode 26 of the array. The two outer anodes 26 are secured to the bus bar 36 by a horizontal member 38 and by vertical members 40 extending downwardly from the ends of the horizontal member 38 and having respective lower ends each fixed to a respective one of the outer anodes. The lower end of the vertical bus bar 36 and the lower ends of the vertical members 40 are suitably secured to corresponding anodes 26 such as by casting the lower ends directly into the anodes 26.

The bus bar assembly 32 also includes means for releasably securing the vertical bus bars 36 to the horizontal bus bar 34. While various releasable securing means can be employed, in the illustrated arrangement each vertical bus bar 36 is secured to the horizontal bus bar 34 via a clamp assembly 41. As shown in FIG. 5, the clamp assembly 41 is preferably a conventional loose-screw type mechanism. The clamp assembly 41 includes a pair of spaced, vertically extending plates 42 which are fixed to the horizontal bus bar 34, which extend on opposite sides of the associated vertical bus bar 36, and which define respective cradles 43. The clamp assembly 41 also includes a clamp member 44 which is locatable between the plates 42 and which has thereon opposed projections 45 locatable in the cradles 43. When the projections 45 are seated in the cradles 43, the vertical bus bar 36 is between the clamp member 44 and the horizontal bus bar 34. A screw 46 is threaded through the clamp member 44. When the screw 46 is threaded into the clamp member 44, the inner end of the screw 46 engages the vertical bus bar 36 and clamps the vertical bus bar against the horizontal bus bar 34. Thus, the clamp assembly 41 can be tightened so as to fix the vertical bus bar 36 and the anodes 26 in the corresponding array in position above the cell floor 20 after the anode-cathode gap 30 has been set, as is further explained below.

The bus bar assembly 32 is provided with DC current from a remote electrical source (not shown) and functions as the electrical lead for the anodes 26. Thus, the horizontal bus bar 34 and the vertical bus bars 36 are preferably made of copper or other suitable electrically conductive material.

Figure 2:
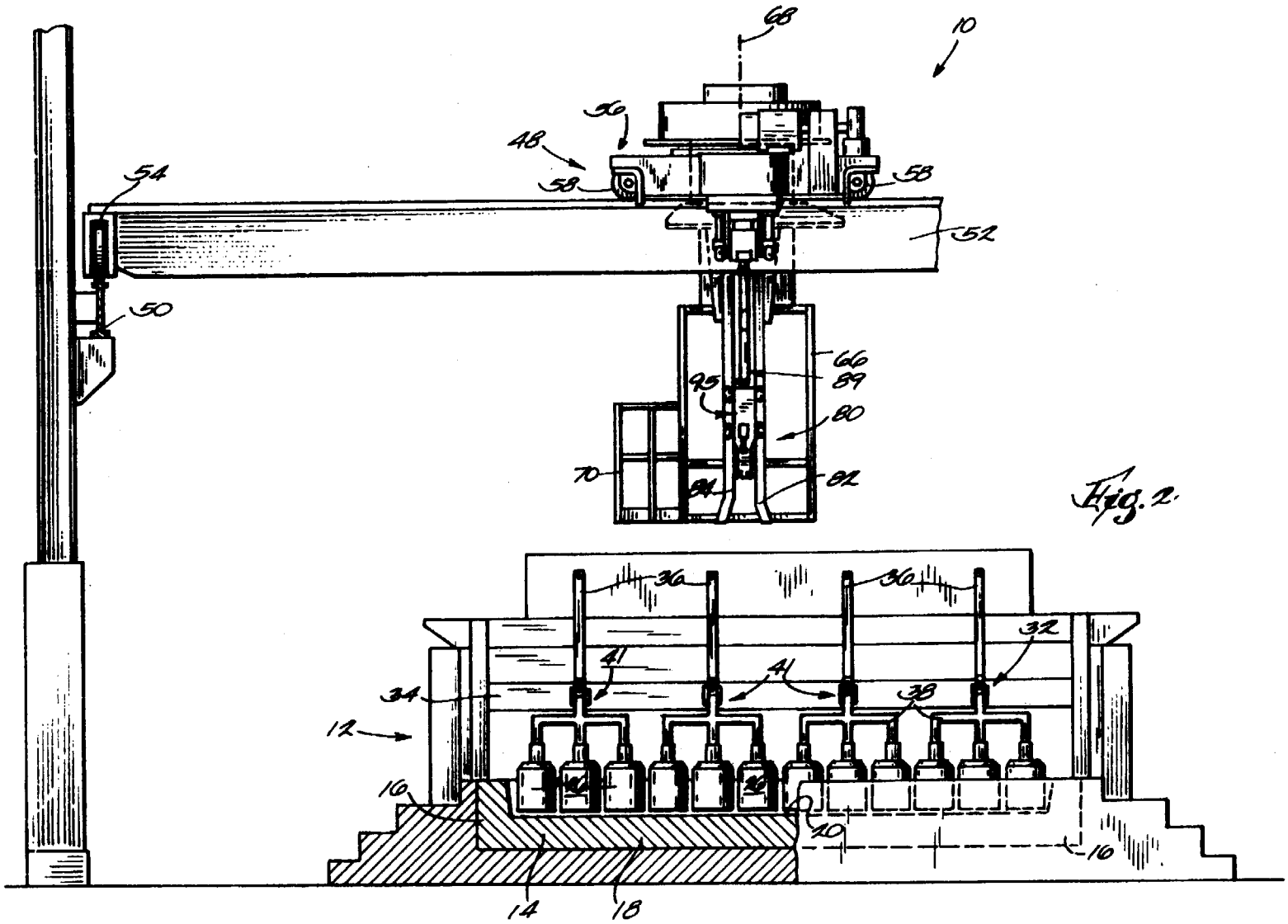
FIG. 2 is a partially cut away reduced end elevational view of a portion of the smelting apparatus illustrated in FIG. 1.

The smelting apparatus 10 also comprises an overhead crane 48 for servicing the electrolytic cells 12. As shown in FIG. 2, the crane 48 includes a pair of spaced apart, parallel runways 50 (only one is shown). The runways 50 extend horizontally on opposite sides of the electrolytic cells 12. The overhead crane 48 also includes a pair of spaced apart, parallel bridge girders 52 extending perpendicularly and horizontally between the runways 50. In the illustrated arrangement, motor driven rollers 54 (only one is shown) move the girders 52 along the runways 50. The rollers 54 are mounted adjacent the opposite ends of the girders 52 (FIG. 2) to support the girders 52 for rolling movement back and forth along the runways 50.

The crane 48 also includes a trolley 56 extending between the girders 52. Rollers 58 positioned at the four corners of the trolley 56 support it for rolling movement along the girders 52. Means are provided for moving the trolley 56 from side to side along the girders 52. In the illustrated arrangement, such means includes a driven shaft 60 (FIG. 1) driving a pair of rollers 58. The shaft 60 is driven through a suitable transmission 62 by an electric motor 64.

The crane 48 further includes a frame 66 supported on the trolley 56 for rotation relative thereto about a generally vertical axis 68. The frame 66 includes an operator cab 70. The crane 48 as thus far described is conventional and need not be described in greater detail.

Means are provided on the frame 66 for automatically operating the clamp assemblies 41 to selectively secure or release the vertical bus bars 36 relative to the horizontal bus bar 34. While various means can be employed, in the illustrated arrangement, such means includes a hydraulic wrench mechanism 72 controllable from the cab 70. As shown in FIG. 1, the wrench mechanism 72 includes a pair of telescoping support members 74 pivotally connected at their upper ends to the frame 66. The wrench mechanism 72 also includes a clamp wrench 76 connected between the lower ends of the support members 74. The clamp wrench 76 is hydraulically rotatably driveable to turn the screw 46 of a clamp assembly 41 and thereby lock or unlock the clamp assembly 41.

To manipulate the anodes 26 when they are released from the horizontal bus bar 34, the smelting apparatus 10 also comprises an anode positioning hoist 80. The hoist 80 includes a pair of channel members 82 and 84 mounted on the frame 66 and defining therebetween opposed generally vertical channels 86 and 88.

Figure 6:
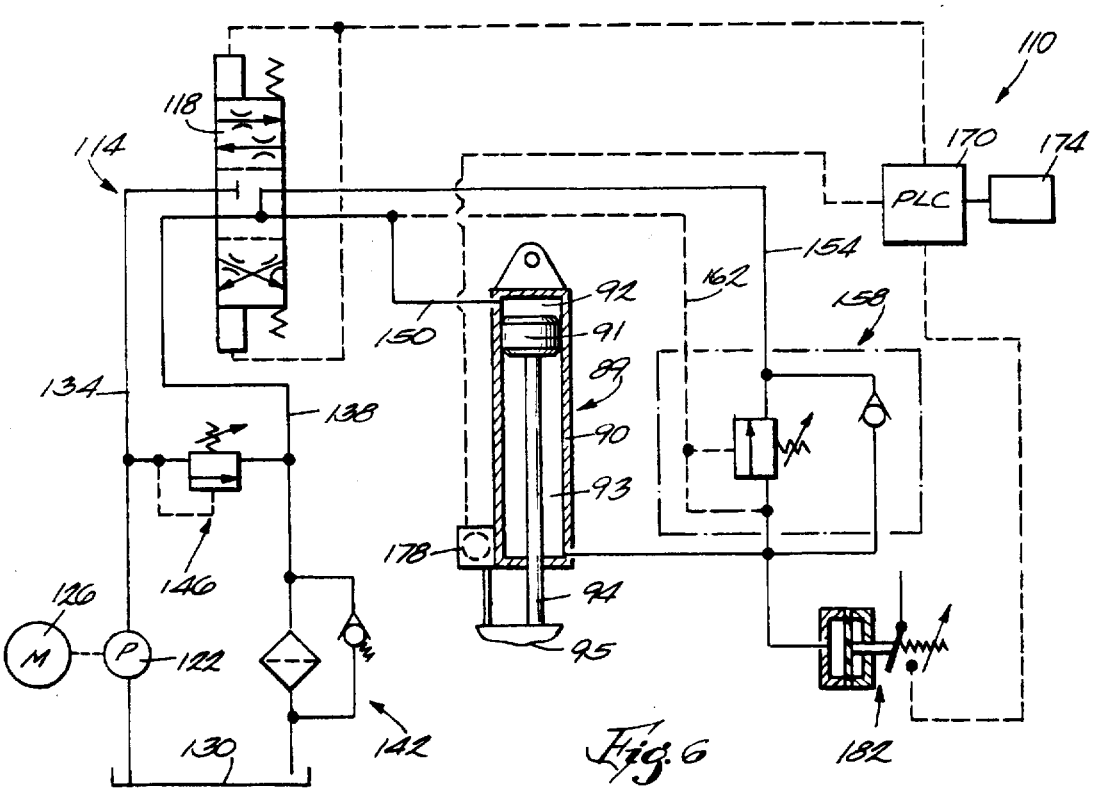
FIG. 6 is a partial schematic view of the hydraulic and electrical systems of the anode positioning hoist.

To accurately position the anodes 26 with respect to the cell floor 20, the anode hoist 80 includes first means for automatically moving the anodes 26 of an array downwardly until the downwardly facing surface 28 of at least one of the anodes 26 engages the cell floor 20, and second means for thereafter automatically moving the array of anodes 26 upwardly a predetermined distance to provide a desired anode-cathode gap 30. While various means for raising and lowering the anodes 26 can be used separately or in conjunction with each other, in the illustrated arrangement, such means both include a single double-acting cylinder/piston assembly 89. The cylinder/piston assembly 89 includes a vertically extending cylinder 90, fixed to the frame 66 between the channel members 82 and 84, a piston 91 (FIG. 6) dividing the cylinder into upper and lower chambers 92 and 93, and a piston rod 94 extending downwardly from the piston 91.

The cylinder/piston assembly 89 also includes means for releasably securing an anode 26 to the piston rod 94 to facilitate manipulation of the anode 26 by the anode hoist 80. The securing means includes a carrier 95 fixed to the lower end of the piston rod 94 for movement therewith. As shown in FIG. 4, the carrier 95 includes insulated rollers 96 guided in the channels 86 and 88. The securing means also includes means for releasably securing the anode 26 to the carrier 95. In the embodiment illustrated in the drawings, such means includes a connector assembly 97 (FIG. 7) on the lower end of the carrier 95. The connector assembly 97 includes a frame 98 that can receive the upper end of a vertical bus bar 36. The connector assembly 97 also includes a pivot member 99 mounted on the frame 98 for pivotal movement relative thereto about a generally horizontal axis. The pivot member 99 has thereon a pin 100 and is movable relative to the frame 98 between an engaged position and a disengaged position (see FIG. 7). Any suitable means, such as a hydraulic assembly 101, can be used to move the pivot member 99 between its engaged and disengaged positions. When the upper end of a vertical bus bar 36 is housed within the frame 98 and the pivot member 99 is in its engaged position, the pin 100 extends through the bore 37 in the vertical bus bar 36 so as to secure the vertical bus bar 36 relative to the carrier 95. When the pivot member 99 is in its disengaged position, the vertical bus bar 36 is free to move into and out of the frame 98.

Thus, a vertical bus bar 36 is secured to the carrier 95 by lowering the carrier 95 so that the upper end of the vertical bus bar 36 extends into the frame 98, and then moving the pivot member 99 to its engaged position. Thereafter, the vertical bus bar 36 moves up and down in common with the carrier 95.

The means for raising and lowering the anodes 26 also include a control system 110 to control and monitor operation of the cylinder/piston assembly 89. The control system 110 is shown schematically in FIG. 6. The control system 110 includes a hydraulic system 114 operably connected to the cylinder/piston assembly 89. The hydraulic system 114 includes a spring-centered, proportional directional valve 118 controlled by the operator in a manner described below. A fixed displacement pump 122 is driven by a motor 126 and pumps hydraulic fluid from a sump 130 to a pressure line 134 communicating between the pump 122 and the valve 118. A return line 138 communicates between the valve 118 and the sump 130 and has therein a conventional filter arrangement 142. A conventional relief valve 146 communicates between the pressure line 134 and the return line 138. An upper chamber line 150 communicates between the valve 118 and the upper chamber 92 of the cylinder 90, and a lower chamber line 154 communicates between the valve 118 and the lower chamber 93 of the cylinder 90. A counterbalance valve 158 is located in the lower chamber line 154 between the valve 118 and the cylinder 90. The counterbalance valve 158 allows unrestricted fluid flow from the valve 118 to the lower chamber 93, but allows fluid flow from the lower chamber 93 to the valve 118 only when the fluid pressure in either of the upper and lower chambers 92 and 93 exceeds a selectively variable, predetermined pressure. To this end, the counterbalance valve 158 includes a pilot line 162 communicating with both the upper chamber line 150 and the lower chamber line 154. The valve 118 is electrically actuated and is movable between a first or center position (shown in FIG. 6), a second or upper position, and a third or lower position. The valve 118 is spring biased to its center position.

When the valve 118 is in its center position, the pressure line 134 is closed off and the return line 138 communicates with both the upper chamber line 150 and the lower chamber line 154. This provides communication between both lines 150 and 154 and the sump 130, resulting in relatively low pressure in both lines. This low pressure, which is less than the pressure needed to open the counterbalance valve 158, closes the counterbalance valve 158, thus preventing fluid flow out of the lower cylinder chamber 93. As a result, the piston 91 and the piston rod 94 are locked in position.

When the valve 118 is in its upper position, the pressure line 134 communicates with the upper chamber line 150 and the return line 138 communicates with the lower chamber line 154. This provides fluid under pressure to the upper chamber line 150. This pressure acts through the pilot line 162 to open the counterbalance valve 158, so that fluid flows into the upper chamber 92 through the upper chamber line 150 and flows out of the lower chamber 93 through the lower chamber line 154. The result is controlled, downward movement of the piston 91 and the piston rod 94.

When the valve 118 is in its lower position, the pressure line 134 communicates with the lower chamber line 154 and the return line 138 communicates with the upper chamber line 150. This causes fluid flow into the lower cylinder chamber 93 and fluid flow out of the upper cylinder chamber 92, thereby causing upward movement of the piston 91 and the piston rod 94.

The control system 110 also includes a programmable logic controller (PLC) 170 operably connected to the valve 118, and an operator-actuated control 174 which is located in the cab 70 and which provides input to the PLC 170. The control system 110 also includes a cylinder-mounted digital encoder 178 operably connected to the cylinder/piston assembly 89 to monitor piston rod movement. The digital encoder 178 provides the PLC 170 with a signal indicative of the position of the piston rod 94. The PLC 170 in turn provides a digital display, in the cab 70, indicating the position of the piston rod 94 (and thus the carrier 95 and an attached anode). The digital encoder 178 is conventional and will not be described in greater detail.

The control system 110 also includes means for causing retraction of the piston rod 94 a predetermined distance after the downwardly facing surface 28 of one of the anodes 26 engages either the cell floor 20 or an obstruction. Such means preferably includes (see FIG. 6) a pressure switch 182 connected to the counterbalance valve 158. The switch 182 is normally open and is closed by excessive pressure in the cylinder 90. The pressure needed to close the pressure switch 182 is higher than the pressure needed to open the counterbalance valve 158. When closed, the pressure switch 182 sends a signal to the PLC 170, and the PLC 170 automatically moves the valve 118 to its lower position, for a predetermined period of time, and thereby causes upward movement of the piston rod 94 a distance equal to the predetermined anode-cathode gap 30. Thereafter, the PLC 170 returns the valve 118 to its center position. At the same time, the PLC 170 turns on a light in the cab 70 to indicate that downward movement of the piston rod 94 has stopped. If movement of the piston rod 94 stops while the operator is lowering the anodes 26, the operator must look at the digital display of piston rod position to determine whether the anodes 26 have been stopped by the cell floor 20 or by an obstruction.

Preferably, the operator can set the control system 110 on automatic mode, wherein the PLC 170 automatically lowers the anodes 26 until the pressure switch 182 is closed. However, regardless of whether the control system 110 is in automatic mode or manual mode (in which the operator manually controls the position of the valve 118), the PLC 170 takes over when the pressure switch 182 is closed and causes raising of the anodes 26 a distance equal to the desired anode-cathode gap 30.

To position the anodes 26, the crane 48 is operated to first position the anode hoist 80 above a selected one of the vertical bus bars 36. The operator then extends the piston rod 94 until the upper end of the selected vertical bus bar 36 is received in the connector assembly 97. After the bus bar 36 is secured in the connector assembly 97 and the associated clamping assembly 41 is unlocked via the wrench mechanism 72, the operator is free to manipulate the selected vertical bus bar 36 and associated array of anodes 26. To set the anodes 26, the piston rod 94 is extended by the operator. When the operator has lowered the anodes 26 to a position directly above the pot 14, the operator switches to automatic mode. If the pressure switch 182 is closed, the array of anodes 26 is automatically raised a designated number of encoder counts corresponding to the desired anode-cathode gap 30. The operator determines whether the anodes 26 have engaged the cell floor 20 or an obstacle by referring to the encoder count. If an obstruction has been encountered, the operator can reposition the array of anodes 26 to clear the obstruction before again lowering the anodes 26. After the selected anode array is properly positioned in the electrolytic cell 12, the associated vertical bus bar 36 is clamped to the horizontal bus bar 32, and the bar 36 is released from the connector assembly 97. The anode hoist 80 can then be repositioned to repeat the process on another array of anodes 26.

Advantageously, the anode hoist 80 is remotely operable to manipulate the anodes 26 and is controllable by the control system 110 to automatically and accurately position the anodes 26 to obtain a proper predetermined anode-cathode gap 30. Unlike prior manual anode setting techniques, operation of the anode hoist 80 is not affected by extraneous factors such as anode height or cell floor unevenness. For reasons including improved safety, the control system 110 is provided with the mechanical counterbalance valve 158, which automatically closes in the event of loss of electrical power or fluid pressure. This feature automatically locks the cylinder/piston assembly 89 in position in the event of equipment malfunction or failure. The pressure switch 182 and the digital encoder 178 also permit an operator to easily monitor piston rod position and anode-cathode spacing.

As a further advantage, the anode hoist 80 is useful to reduce the amount of time workers are in the area proximate the electrolytic cell 12 and is further useful to reduce the time and eliminate the guesswork employed in manual anode positioning techniques.

Other features and advantages of the invention are set forth in the following claims.

We claim:

1. A hoist apparatus for positioning the anode relative to the cathode of a smelting furnace, the cathode having an upwardly facing surface, and the anode having a downwardly facing surface, said apparatus comprising a pair of channel members which are adapted to be supported by a crane and which define opposed, generally vertical channels, a cylinder/piston assembly including a vertically extending cylinder located between said channel members, and a piston rod extending downwardly from said cylinder, a carrier fixed to said piston rod for movement therewith, said carrier having thereon rollers guided in said channels, means for releasably securing the anode to said carrier such that the anode moves vertically with said carrier, and a control system which is connected to said cylinder/piston assembly and which includes means for causing extension of said piston rod until the downwardly facing surface of the anode engages the upwardly facing surface of the cathode, and means for thereafter causing retraction of said piston rod a set distance to provide a gap between the anode and the cathode.

2. Smelting apparatus comprising a smelting furnace including a cathode having an upwardly facing surface, a horizontal bus bar extending above said furnace, an anode having a downwardly facing surface, a vertical bus bar having a lower end fixed to said anode, an overhead crane including horizontal, parallel, spaced-apart runways supported above said furnace, horizontal, parallel, spaced-apart bridge girders extending between and perpendicular to said runways, means for moving said bridge girders along said runways, a trolley extending between and supported by said bridge girders, means for moving said trolley along said bridge girders, and a frame supported by said trolley for rotation relative thereto about a generally vertical axis, an anode positioning hoist including a pair of channel members which are supported by said frame and which define opposed, generally vertical channels, a cylinder/piston assembly including a vertically extending cylinder supported by said frame and located between said channel members, and a piston rod extending downwardly from said cylinder, a carrier fixed to said piston rod for movement therewith, said carrier having thereon rollers guided in said channels, means for releasably securing said vertical bus bar to said carrier such that said vertical bus bar and said anode move vertically with said carrier, and a control system which is connected to said cylinder/piston assembly and which includes means for causing extension of said piston rod until said downwardly facing surface of said anode engages said upwardly facing surface of said cathode, and means for thereafter causing retraction of said piston rod a set distance to provide a gap between said anode and said cathode, and means for releasably securing said vertical bus bar to said horizontal bus bar so as to fix said gap.

3. Apparatus as set forth in claim 2 wherein said means for releasably securing said vertical bus bar to said horizontal bus bar includes a locking mechanism fixed to said horizontal bus bar.

4. Apparatus as set forth in claim 3 and further comprising means mounted on said frame for automatically operating said locking mechanism.

5. A method for positioning an anode relative to a cathode of a smelting furnace, the cathode having an upwardly facing surface, and the anode having a downwardly facing surface, said method comprising the steps of (a) moving the anode downwardly until the downwardly facing surface of the anode engages the upwardly facing surface of the cathode, and (b) thereafter moving the anode upwardly a set distance to provide a gap between the anode and the cathode, wherein steps (a) and (b) include providing a cylinder/piston assembly including a vertically extending cylinder and a piston rod extending downwardly from the cylinder, releasably securing the anode to the piston rod, extending the piston rod until the downwardly facing surface of the anode engages the upwardly facing surface of the cathode, and thereafter retracting the piston rod the set distance to provide the gap between the anode and the cathode, wherein steps (a) and (b) also include providing a carrier fixed to the piston rod for movement therewith, and releasably securing the anode to the carrier such that the anode moves vertically with the carrier, and wherein steps (a) and (b) also include providing a pair of channel members which are adapted to be supported by a crane and which define opposed, generally vertical channels, and providing the carrier with rollers guided in the vertical channels.

6. A method as set forth in claim 5 wherein step (a) includes providing a hoist apparatus and using the hoist apparatus to move the anode downwardly until the downwardly facing surface of the anode engages the upwardly facing surface of the cathode.

7. A method as set forth in claim 6 wherein step (b) includes using the hoist apparatus to move the anode upwardly the set distance to provide the gap between the anode and the cathode.

8. A method as set forth in claim 5 wherein steps (a) and (b) also include providing a control system which is connected to the cylinder/piston assembly, and using the control system to cause extension of the piston rod until the downwardly facing surface of the anode engages the upwardly facing surface of the cathode, and to thereafter cause retraction of the piston rod the set distance to provide the gap between the anode and the cathode.

9. A method for positioning an anode relative to a cathode of a smelting furnace, the cathode having an upwardly facing surface, and the anode having a downwardly facing surface, said method comprising the steps of (a) providing a hoist apparatus, (b) using the hoist apparatus to move the anode downwardly until the downwardly facing surface of the anode engages the upwardly facing surface of the cathode, and (c) thereafter using the hoist apparatus to move the anode upwardly a set distance to provide a gap between the anode and the cathode, wherein steps (b) and (c) include providing a cylinder/piston assembly including a vertically extending cylinder and a piston rod extending downwardly from the cylinder, releasably securing the anode to the piston rod, extending the piston rod until the downwardly facing surface of the anode engages the upwardly facing surface of the cathode, and thereafter retracting the piston rod the set distance to provide the gap between the anode and the cathode, wherein steps (b) and (c) also include providing a carrier fixed to the piston rod for movement therewith, and releasably securing the anode to the carrier such that the anode moves vertically with the carrier, and wherein steps (b) and (c) also include providing a pair of channel members which are adapted to be supported by a crane and which define opposed, generally vertical channels, and providing the carrier with rollers guided in the vertical channels.

10. A method as set forth in claim 9 wherein steps (b) and (c) also include providing a control system which is connected to the cylinder/piston assembly, and using the control system to cause extension of the piston rod until the downwardly facing surface of the anode engages the upwardly facing surface of the cathode, and to thereafter cause retraction of the piston rod the set distance to provide the gap between the anode and the cathode.

11. Apparatus for positioning an anode relative to a cathode of a smelting furnace, the cathode having an upwardly facing surface, and the anode having a downwardly facing surface, said apparatus comprising a hoist apparatus for moving the anode upwardly and downwardly, and a control system for causing said hoist apparatus to move the anode downwardly, for sensing when the downwardly facing surface of the anode engages the upwardly facing surface of the cathode, and for thereafter causing the hoist apparatus to move the anode upwardly a set distance to provide a gap between the anode and the cathode.

12. Apparatus as set forth in claim 11 wherein said hoist apparatus includes a cylinder/piston assembly including a vertically extending cylinder and a piston rod extending downwardly from said cylinder, and securing means for releasably securing the anode to said piston rod.

13. Apparatus as set forth in claim 12 wherein said control system is connected to said cylinder/piston assembly and causes extension of said piston rod until the downwardly facing surface of the anode engages the upwardly facing surface of the cathode, and thereafter causes retraction of said piston rod said set distance to provide said gap between the anode and the cathode.

14. Apparatus as set forth in claim 12 wherein said securing means includes a carrier fixed to said piston rod for movement therewith, and means for releasably securing the anode to said carrier such that the anode moves vertically with said carrier.

15. Apparatus as set forth in claim 14 wherein said hoist apparatus also includes a pair of channel members which are adapted to be supported by a crane and which define opposed, generally vertical channels, and wherein said carrier has thereon rollers guided in said vertical channels.

* * * * *